US007356459B2

(12) United States Patent
Bergemann et al.

(10) Patent No.: US 7,356,459 B2
(45) Date of Patent: Apr. 8, 2008

(54) PROGRAM-CONTROLLED HOUSEHOLD APPLIANCE AND METHOD OF OPERATING THE APPLIANCE

(75) Inventors: Heinz-Jürgen Bergemann, München (DE); Gunnar Pautzke, München (DE); Matthias Salein, Berlin (DE); Martin Schwab, Gilching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 264 days.

(21) Appl. No.: 10/680,382

(22) Filed: Oct. 6, 2003

(65) Prior Publication Data

US 2005/0091063 A1 Apr. 28, 2005

Related U.S. Application Data

(63) Continuation of application No. PCT/EP02/03199, filed on Mar. 21, 2002.

(30) Foreign Application Priority Data

Apr. 6, 2001 (DE) ..... 101 17 292

(51) Int. Cl.
*G06F 17/22* (2006.01)

(52) U.S. Cl. ..... 704/8

(58) Field of Classification Search ..... 704/8
See application file for complete search history.

(56) References Cited

U.S. PATENT DOCUMENTS 4,860,678 A 8/1989 Skogward
5,583,761 A * 12/1996 Chou ..... 715/536
5,999,895 A * 12/1999 Forest ..... 704/1
6,182,099 B1 * 1/2001 Nakasato ..... 715/536

FOREIGN PATENT DOCUMENTS

| | | |
|---|---|---|
| DE | 31 33 176 C1 | 10/1982 |
| DE | 38 33 605 C2 | 4/1989 |
| DE | 39 13 638 A1 | 10/1990 |
| DE | 297 14 901 U1 | 2/1999 |
| DE | 198 30 844 A1 | 1/2000 |
| DE | 199 05 533 A1 | 8/2000 |
| DE | 100 35 642 C1 | 12/2001 |
| GB | 2 156 310 A | 10/1985 |
| JP | 9-105998 | 4/1997 |
| JP | 2000-184472 | 6/2000 |
| JP | 2001-28718 | 1/2001 |

* cited by examiner

*Primary Examiner*—Donald L. Storm
(74) *Attorney, Agent, or Firm*—Russell W. Warnock; James E. Howard

(57) ABSTRACT

A household appliance with a simple to use selected operating language includes activating the programs by taking into account the special characteristics of specific languages. The household appliance includes a display unit that displays all information in a simple language. The selected language, the selected programming of the household appliance, and the selected additional functions in addition to error messages are shown on the display unit so that operational mistakes are basically prevented.

19 Claims, 1 Drawing Sheet

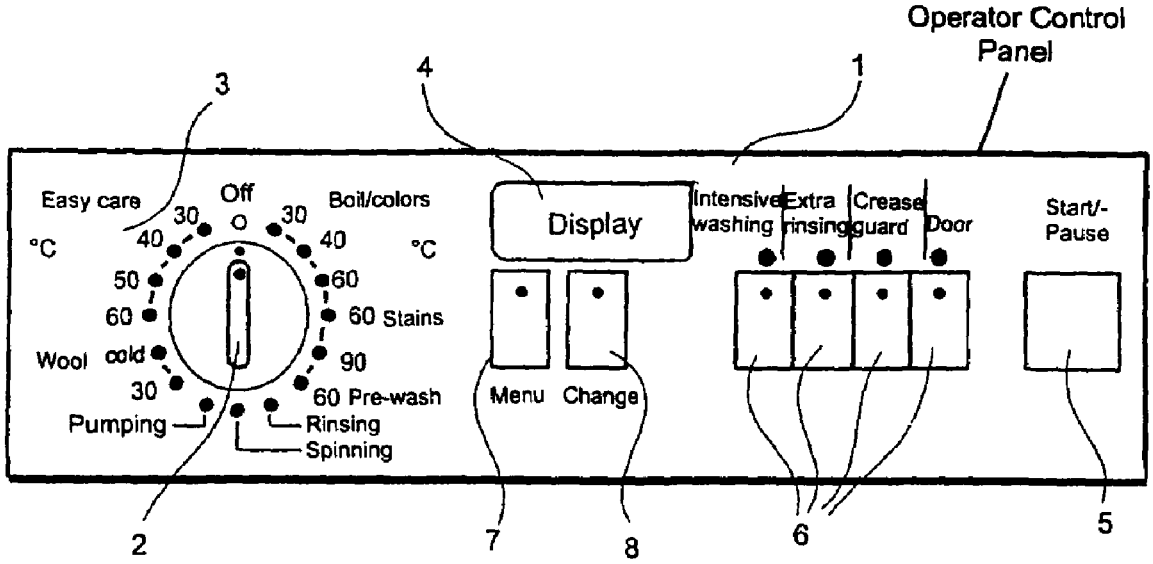
Operator Control Panel
1
2
3
4
5
6
7
8
Easy care
°C
Off
Boil/colors
°C
30
40
50
60
Wool
cold
30
Pumping
30
40
60
60 Stains
90
60 Pre-wash
Rinsing
Spinning
Display
Menu
Change
Intensive washing
Extra rinsing
Crease guard
Door
Start/-Pause

PROGRAM-CONTROLLED HOUSEHOLD APPLIANCE AND METHOD OF OPERATING THE APPLIANCE

CROSS-REFERENCE TO RELATED APPLICATION

This application is a continuation of copending International Application No. PCT/EP02/03199, filed Mar. 21, 2002, which designated the United States and was not published in English.

BACKGROUND OF THE INVENTION

Field of the Invention

The invention relates to a program-controlled household appliance and method of operating the appliance with a set of program sequences that are stored in a suitable memory and are indicated when required, and also with an external program selector, by which programs can be individually selected and activated, it being possible for each position of the program selector to be permanently assigned a program, and with additional functions for the manipulation of the selected program, and also relates to a household appliance suitable for realizing the method, which has in its indicating area elements for program and function selection and elements for informing the user.

The prior art discloses household appliances, specifically, washing machines, in which a selector switch can be used to select a program from a set of programs that are stored in a memory and the program runs automatically after starting, usually initiated by actuating a start button. A program is the term used for a sequence of individual steps proceeding one after the other in time, each individual step being determined by its function, such as washing, rinsing, spinning, and the parameters such as temperature, time duration, and rotational speed. The programs are configured such that an optimum effect is achieved with them with respect to the type and amount of articles to be treated.

The user uses a switch to select a suitable program; the sequence and monitoring of the program take place automatically and the progress of the program is generally indicated on the operator control panel.

In the case of modern household appliances, on the operator control panel there are function buttons, which offer the user the possibility of manipulating the program selected by the selector switch. This takes place by individual program steps being repeated or else skipped. For example, in the case of a washing machine, the "intensive wash" button can be used to extend the time of the program in the "washing" phase, in order to clean unusually heavily soiled laundry with the desired intensity, or the "crease guard" function button can be used to shorten the spinning process or reduce the maximum speed during spinning. The selection of an additional function is generally indicated by a luminous element.

Mechanical and/or electrical operator control elements, in particular, rotary switches and pushbutton switches, are used as switches for the program selection. The selected program is indicated by the position of the selector switch and/or by optical indicating elements such as lamps, LEDs, or displays with LEDs or using LCD technology. In the case of rotary switches, each position of the selector switch may be associated with a symbol, identifiable on the operator control panel, in a viewing window or by a marking present on the selector switch pointing to symbols in the operator control panel.

In the simplest case, numerals are used as the symbols; the various programs are, then, giving consecutive numbers. The user may have to consult the operating instructions to find out that functions carry out the program with the given designation and for which articles to be treated the program is designed. This increases the effort for the user and reduces the acceptance of such a household appliance. If the level of concentration is not adequate, operating errors may occur.

The aim is for the operator control panel to guide the user logically through the input. For such a purpose, information indicated on the operator control panel must be adequate in terms of its amount and meaningfulness to enable the user to select programs and additional functions without error.

So far it has only been possible for this object to be achieved inadequately. The space on the operator control panel is relatively confined, and it quickly becomes cluttered if there is an excessive amount of information or excessively detailed information. This may, again, result in operating errors and a decrease in the acceptance of such a household appliance.

A change has taken place in favor of using numerals and symbols that provide indications of the content of the program. For example, in the case of a washing machine, the maximum washing temperature that can be reached in the case of the selected program may be indicated. The image of a stylized hand in a tub as a symbol for hand washing is generally known and is accepted. A tub with the numeral "95" in it is self-explanatory as a symbol for a boil-washing cycle.

The set of known and self-explanatory symbols is limited. It is problematical from the viewpoint of the manufacturer to extend the number of symbols depicted because there is no standardization and because unknown symbols can lead to misinterpretation and, consequently, to programming errors.

In the case of most household appliances, a mixture of numerals, symbols, and terms in plain text are used, on one hand, to convey maximum information to the user and, on the other hand, to keep the operator display panel uncluttered by limiting the number and length of the information.

It may further help to keep the operator display panel uncluttered if individual operator control elements have dual assignments. For example, the start button can also be used for interrupting the program and restarting it. The desired function is selected by multiple actuation of the button.

All the measures described fail to provide a satisfactorily successful result. Optimum, error-free operation without operating instructions is scarcely possible, in particular, in the case of programs that are rarely used.

A modern household appliance is expected to be able to perform programs that satisfy the increasing requirements for cleanness, environmental compatibility, operating simplicity, new standards, and economy and that offer an optimum program for a constantly extended variety of articles to be specially treated. With the expansion in international trade, the manufacturers operate in many national markets, with the consequence that such household appliances must meet the special requirements of the respective intended country. The aim of the manufacturers is to produce a uniform basic model and adapt it to the special needs of the national markets by measures that are as simple as possible. One measure could include sticking a sheet bearing plain text in the desired national language over areas of the operator control panel that have inscriptions in plain text. This method has the advantage that the manufacturer can produce a model of the household appliance that is the same for all export countries and the country-specific adaptation of the household appliance can be performed locally by the seller or the user. It constitutes additional effort that each household appliance must be accompanied by a range of sheets in various languages. Such an effort is inconsiderable in comparison with the obvious advantages. A major disadvantage is that the use of sheets adversely affects the overall appearance of the operator control panel, for instance, the sheet can be stuck on improperly or the sheets can become easily soiled and/or torn, in particular, at the edges. Such a variant is incompatible with the high demands expected of a modern household appliance.

To overcome these drawbacks, household appliances are equipped with operator control panels that are specifically designed for a language region. For this purpose, it is necessary to produce different types of household appliance equipped with different operator control panels in accordance with the number of export countries. In addition to the relatively minor extra effort in production, there is increased effort in sales. The production of specially equipped household appliances for different language regions increases the effort involved in stock-keeping, while reducing sales flexibility, for instance, when sales fluctuate. For example, a household appliance produced for the English language region cannot be sold in Germany, or only with difficulty.

In an indicating and operating unit known from German Patent DE 31 33 176 C1 for computer-controlled, electrical household appliances, it is provided that the language of the indication can be selected by a keypad. It is also known from German Published, Non-Prosecuted Patent Application DE 198 30 844 A1 to perform in accordance with the set national language an automatic allocation of programs (cooking recipes) existing in all national variants, and, consequently, to make allowance for a specific frequency of programs respectively called up. This means that, for example, a pork-roast recipe is provided in the same form in German descriptions as in descriptions in any other language, but, given a different choice of national languages, is offered in a different sequence on a program list available for selection.

SUMMARY OF THE INVENTION

It is accordingly an object of the invention to provide a program-controlled household appliance and method of operating the appliance that overcome the hereinafore-mentioned disadvantages of the heretofore-known devices and methods of this general type and that, starting from a basic model of a household appliance that is the same for all countries, allow the specific adaptation of programs to the individual intended countries to be made possible by simple manipulations carried out locally by the seller or user. The operating convenience of the household appliance is to be improved and the household appliance is to satisfy all aesthetic requirements.

With the foregoing and other objects in view, there is provided, in accordance with the invention, a method of operating a program-controlled household appliance, including storing a set of program sequences in a memory and indicating the program sequences when required, permanently storing a set of programs specific to language regions in the memory, individually selecting and activating at least one of the programs with an external program selector having selector positions, permanently assigning each of the selector positions to at least one of the programs, providing additional functions for manipulation of a program selected by the program selector, selecting a desired indicating language by input manipulation, and making available an associated set of programs specific to language regions for selection by the program selector when an indicating language is selected.

It is also an object of the invention to adapt the household appliance of the same basic type in an easy way with regard to specific program selections to the conditions and special circumstances in different countries.

According to the invention, a set of programs specific to language regions is permanently stored in the memory, a desired indicating language is selected by input manipulation, and an assigned set of programs specific to language regions is made available for selection by the program selector when an indicating language is selected. As such, just by selecting a desired language for the indicating elements, the user can activate a set of data associated with this language concerning programs and user information, without further interventions being necessary in relation to individual programs specific to language regions.

It is important for the invention that a set of user information items and a set of data for controlling the programs are contained in the memory. In this respect, the user information may contain a package of equivalent terms and additional terms that refer to special features or program steps that can be called up only for one country or a number of countries associated with the same language region.

The household appliance according to the invention is distinguished, in particular, by the fact that all the relevant information, such as the designation of the selected program, the progress of the program, the additional functions, and the language selection, are indicated in plain text by a display that is disposed in the operator control panel and is controlled by the treatment program.

In a refinement of the invention, it is envisaged to output the user information items successively on the display. Consequently, it is possible with a predetermined display to indicate more information and more precise information, which make operator control more reliable.

The invention offers further advantages. Faults and operator errors can be indicated in the selected national language, as can suggestions for optimum program composition. The information indication according to the invention allows the user to be guided in a logical way by the display; the amount of information can be extended, without the risk of cluttering; the plain-text representation cannot be misinterpreted; operator errors are virtually ruled out.

The invention may be set up such that the language selection is controlled by the display. After calling up the selection function, a switching element is used to indicate on the display each language present in the menu one after the other. After confirmation of the selected language, the set of information items associated with this language is activated internally; the operator instructions and the specified program steps are permanently associated with the corresponding position of the program selector. After that, the program selection, the indication of the progress of the program, the error and fault messages, and, also, the additional functions are indicated on the display in the language chosen by the user. Similarly, the treatment programs proceed in the way specified for the country.

The method according to the invention gives the manufacturer the possibility of covering the different requirements of the specific markets with just one household appliance that is the same for all countries. Consequently, the effort involved in production, but, in particular, in the operational, sales, and customer-service organizations, can be reduced considerably. The invention offers further advantages. The set of stored national languages can be extended without any great effort.

The selection of a specific national language from the set of stored languages is reversible, i.e., the chosen language can be replaced by another at any time and as often as desired.

A special refinement of the invention envisages selecting the set of user information items in one language and the program control functions for a different country. This provides the possibility, for example, of adapting the programs in a way corresponding to the conditions in British households, but to choose German as the operating language.

In accordance with another mode of the invention, the set of programs specific to language regions is provided with corresponding user information.

In accordance with a further mode of the invention, the indicating language is selected with a selector switch.

In accordance with an added mode of the invention, after selecting the indicating language, each position of the program selector is permanently assigned a program specific to a language region and each program is permanently assigned a set of user information items specific to a language region.

In accordance with an additional mode of the invention, the indicating language selecting step is reversible.

In accordance with yet another mode of the invention, the programs specific to countries and the user information specific to languages are separately selected from one another.

In accordance with yet a further mode of the invention, the language selection is acknowledged with an indicating element.

In accordance with yet an added mode of the invention, the selected indicating language is acknowledged with an indication of an internationally intelligible symbol. Preferably, the symbol is a letter or a word in the selected language.

In accordance with yet an additional mode of the invention, an operating state and/or a program sequence is indicated with one of internationally customary symbols and terms customary in the selected language, the symbols and terms being permanently associated with the program.

With the objects of the invention in view, in a program-controlled household appliance, there is also provided, a control panel including a memory storing a set of program sequences, a controller connected to the memory and programmed to execute the program sequences and indicate the program sequences, an external program selector having selector positions, the program selector connected to the controller for individually selecting and activating the programs, each of the selector positions being permanently assigned to one of the programs, functional units for manipulating a selected one of the programs, an indicating area having program and function selection elements, informational elements for informing a user about a selection of the programs and the functional units, and a display as an indicating element for indicating respective ones of the programs and parameters of the programs, the memory storing a set of programs, from which at least two different ones of the programs can be called up specifically for language regions, and operator control elements functionally linked to a command control of the controller for a selection of languages and programs specific to at least one of language regions and user information.

In accordance with again another feature of the invention, the display indicates the selected language.

In accordance with again a further feature of the invention, the external program selector is a rotary selector having a number of positions for selecting the programs and each of the positions is assigned an indicating element displaying an alphanumeric indication.

In accordance with again an added feature of the invention, the indicating element is a single display on which an assigned program is indicated according to a position of the rotary selector.

In accordance with a concomitant feature of the invention, the indication of the program on the display contains therein individual parameters of a selected one of the programs.

Other features that are considered as characteristic for the invention are set forth in the appended claims.

Although the invention is illustrated and described herein as embodied in a method of operating a program-controlled household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is an operator control panel of a washing machine according to the invention.

DESCRIPTION OF THE PREFERRED EMBODIMENTS

Referring now to the single FIGURE of the drawing, it is seen that an important feature of the washing machine is the display 4 in the operator control panel 1, which serves for indicating all user information in plain text. The meaningful content of the information conveyed in plain text is composed such that the user is reliably guided even without operating instructions.

The adaptation of the washing machine to the country-specific needs and conditions begins with the selection of the national language. By actuating the button 7, the "language selection" menu stored in the memory is activated. On the display 4, a language is indicated in plain text. This takes place in the way customary for the country, for example "Deutsch," "English," "Polski," etc. By actuating the button 8, each language stored in the language menu is indicated on the display 4 one after the other. When the desired language appears on the display 4, it is activated with the start button 5. Activating the national language causes each position of the selector switch 2 to be internally assigned a program that includes, as required, a sequence of steps deviating country-specifically from the standard program. The programs are adapted to the specific requirements of individual countries and the conditions prevailing there, for instance, the fact that in British households there are frequently hot water connections. It is, consequently, possible that, with the same position of the selector switch 2, the washing machine carries out a different sequence of program steps in Germany than in the UK.

Once the selected language has been activated, the language indication on the display 4 goes out. After that, the "program selection" menu can be activated with the control button 7. The program is selected in the usual way by turning of the selector switch 2; the designation of the program appears on the display. This indication goes out after about 10 seconds and is overwritten by information concerning the operating state or the progress of the program, such as, for example, the temperature of the water, the time of day, and the remaining running time of the washing program.

Also indicated on the display 4 are the activated additional functions, corresponding to the assignment of the buttons 6, and also operator errors when incorrect functions are selected. An operator error is indicated, for example, if the "intensive wash" function has been activated and the rinsing program has been set by the program selector. Operating faults in the water supply or improper closing of the loading door are, likewise, indicated in the selected national language on the display 4. The usual signaling tone has a supporting effect, in the sense that the user is requested to act in a way corresponding to the error message because interpretation of previously customary luminous signals and/or symbols is no longer required. The major advantage of the washing machine according to the invention is the output of all program information through the display in plain text and, also, the support of the selection functions by the display. Operator errors by the user are, consequently, virtually ruled out; operating instructions are usually superfluous.

We claim:

1. A method of operating a program-controlled household appliance, which comprises:

storing a set of program sequences in a memory and indicating the program sequences when required;

permanently storing a set of programs specific to language regions in the memory, wherein the act of permanently storing a set of programs specific to language regions in the memory includes storing a first set of programs corresponding to a first language region and storing a second set of programs corresponding to a second language region, the first set and the second set of programs each having a different sequence of program steps from one another;

individually selecting and activating at least one of the programs with an external program selector having selector positions;

permanently assigning each of the selector positions to at least one of the programs;

providing additional functions for manipulation of a program selected by the program selector;

selecting a desired indicating language by input manipulation; and making available an associated set of programs specific to language regions for selection by the program selector when an indicating language is selected.

2. The method according to claim 1, which further comprises providing the set of programs specific to language regions with corresponding user information.

3. The method according to claim 1, which further comprises selecting the indicating language with a selector switch.

4. The method according to claim 1, which further comprises, after selecting the indicating language, permanently assigning each position of the program selector a program specific to a language region and permanently assigning each program a set of user information items specific to a language region.

5. The method according to claim 1, which further comprises providing the indicating language selecting step as a reversible indicating language selecting step.

6. The method according to claim 1, which further comprises reversing the indicating language selecting step after selecting the desired indicating language by input manipulation.

7. The method according to claim 2, which further comprises separately selecting the programs specific to countries and the user information specific to languages from one another.

8. The method according to claim 1, which further comprises acknowledging the language selection with an indicating element.

9. The method according to claim 1, which further comprises acknowledging the selected indicating language with an indication of an internationally intelligible symbol.

10. The method according to claim 9, wherein the symbol is at least one of a letter and a word in the selected language.

11. The method according to claim 1, which further comprises indicating at least one of an operating state and a program sequence with one of internationally customary symbols and terms customary in the selected language, the symbols and terms being permanently associated with at least one of the programs.

12. A method of operating a program-controlled household appliance with a set of program sequences stored in a memory and indicated when required, with an external program selector, by which programs are individually selected and activated, each position of the program selector being permanently assigned a program, and with additional functions for manipulation of a selected program, which comprises:

permanently storing multiple sets of programs in the memory with each set of programs being specific to a language region;

selecting a desired indicating language by manipulating the external program selector having selector positions permanently assigned to at least one of the sets of programs; and making available the set of programs specific to the language region for selection by the program selector corresponding to the selected indicating language.

13. The method according to claim 12, wherein the act of permanently storing multiple sets of programs in the memory with each set of programs being specific to a language region includes storing a first set of programs corresponding to a first language region and storing a second set of programs corresponding to a second language region, the first set and the second set of programs each having a different sequence of program steps from one another.

14. In a program-controlled household appliance, a control panel comprising:

a memory storing a set of programs;

a controller connected to said memory and programmed to execute said programs and indicate said programs;

an external program selector having selector positions, said program selector connected to said controller for individually selecting and activating said programs, each of said selector positions being permanently assigned to one of said programs;

functional units for manipulating a selected one of said programs;

an indicating area having:

program and function selection elements;

informational elements for informing a user about a selection of said programs and said functional units; and a display as an indicating element for indicating respective ones of said programs and parameters of said programs;

said memory storing multiple sets of programs with each set of programs being specific to a language region, from which one of the multiple sets of programs specific to a language region can be called up; and operator control elements functionally linked to a command control of said controller for a selection of languages and programs specific to at least one of language regions and user information.

15. The household appliance according to claim 14, wherein said display indicates a language selected from the selection of languages.

16. The household appliance according to claim 14, wherein:

said external program selector is a rotary selector having a number of positions for selecting said programs; and each of said positions is assigned an indicating element displaying an alphanumeric indication.

17. The household appliance according to claim 16, wherein said indicating element is a single display on which an assigned program is indicated according to a position of said rotary selector.

18. The household appliance according to claim 17, wherein the indication of said program on said display contains therein individual parameters of a selected one of said programs.

19. The household appliance according to claim 14, wherein the multiple sets of programs includes a first set of programs corresponding to a first language region and storing a second set of programs corresponding to a second language region, the first set and the second set of programs each having a different sequence of program steps from one another.

* * * * *